US007730653B2

(12) United States Patent
Zazworsky, Jr.

(10) Patent No.: US 7,730,653 B2
(45) Date of Patent: Jun. 8, 2010

(54) INFORMATION DISPLAY SYSTEM

(75) Inventor: Ronald Zazworsky, Jr., Atlanta, GA (US)

(73) Assignee: Georgia Production & Supply, LLC, Atlanta, GA (US)

( * ) Notice: Subject to any disclaimer, the term of this patent is extended or adjusted under 35 U.S.C. 154(b) by 511 days.

(21) Appl. No.: 11/643,206

(22) Filed: Dec. 20, 2006

(65) Prior Publication Data

US 2007/0209258 A1 Sep. 13, 2007

Related U.S. Application Data

(60) Provisional application No. 60/754,300, filed on Dec. 29, 2005.

(51) Int. Cl.
*G09F 15/00* (2006.01)

(52) U.S. Cl. ..... 40/607.05; 40/606.03; 206/555

(58) Field of Classification Search ..... 40/607.05, 40/607.09, 606.12, 606.06, 308, 607.14, 40/606.03; 232/19
See application file for complete search history.

(56) References Cited

U.S. PATENT DOCUMENTS 688,179 A * 12/1901 Kerr et al. ..... 312/60
871,936 A 11/1907 Hillman
1,270,883 A 7/1918 Scott
1,638,193 A 8/1927 Forwood
1,656,150 A 1/1928 Little
1,704,199 A 3/1929 Little
D102,230 S 12/1936 Longomarsino
D148,702 S 2/1948 Holmgren
D152,688 S 2/1949 Hammond
2,678,707 A 5/1954 Finkelstin
2,723,474 A * 11/1955 Minter ..... 40/651
4,154,383 A * 5/1979 Honatzis ..... 224/556
4,201,291 A * 5/1980 Davidson ..... 206/768
D264,731 S 6/1982 Shuman
D280,563 S 9/1985 Cobb
4,623,073 A * 11/1986 Hansen ..... 221/45
4,660,310 A 4/1987 Farmer
4,866,866 A 9/1989 Rotter et al.
5,012,966 A * 5/1991 Turner et al. ..... 224/277
5,042,183 A 8/1991 Kennedy
5,307,580 A 5/1994 Farmer
D348,906 S 7/1994 Hubble
D361,794 S 8/1995 Oakley
5,450,681 A * 9/1995 Stolzman ..... 40/308
D367,078 S 2/1996 Oakley
5,595,300 A 1/1997 Paik et al.
D391,301 S 2/1998 Davis (Continued)

OTHER PUBLICATIONS

The INFO-Box (TM); www.infotube.net/catalog/product_info.php?cPath=21&products_id=61; Dec. 16, 2004.

*Primary Examiner*—Lesley Morris
*Assistant Examiner*—Kristina Staley
(74) *Attorney, Agent, or Firm*—Kilpatrick Stockton LLP; Camilla C. Williams

(57) ABSTRACT

An information display system provides an effective device for the storage and display of information. An H-shaped frame provides easy installation and ease of manufacture. An information storage unit is attached to the H-shaped frame and provides a sealed unit that is easy to access but that protects the contents from exposure to the elements.

4 Claims, 5 Drawing Sheets

U.S. PATENT DOCUMENTS

| | | | | |
|---|---|---|---|---|
| 5,815,965 | A | 10/1998 | Greeve | |
| 5,903,991 | A * | 5/1999 | Sasse | 40/607.04 |
| D410,496 | S | 6/1999 | Wyse | |
| 6,070,744 | A | 6/2000 | Levinson et al. | |
| D433,713 | S | 11/2000 | Olivetti | |
| D434,083 | S | 11/2000 | Vance | |
| D450,775 | S | 11/2001 | Albrecht | |
| D478,938 | S | 8/2003 | Hey | |
| D485,312 | S | 1/2004 | Gaska et al. | |
| 6,718,671 | B1 * | 4/2004 | Cluff | 40/611.03 |
| 6,871,779 | B1 * | 3/2005 | Whitney, Jr. | 232/45 |
| 6,971,198 | B2 | 12/2005 | Venegas, Jr. | |
| 7,216,798 | B2 * | 5/2007 | Stephens et al. | 232/39 |
| 7,389,603 | B1 * | 6/2008 | Brumfield | 40/607.05 |
| 7,506,465 | B2 | 3/2009 | Hansen | |
| 2006/0080876 | A1 * | 4/2006 | Carter | 40/607.09 |
| 2006/0101690 | A1 | 5/2006 | Terbet, Jr. | |
| 2007/0000162 | A1 | 1/2007 | Meeker et al. | |

* cited by examiner

INFORMATION DISPLAY SYSTEM

CROSS-REFERENCE TO RELATED APPLICATIONS

This application claims priority to U.S. Application No. 60/754,300, filed Dec. 29, 2005, which is incorporated herein by this reference.

FIELD OF THE INVENTION

This invention relates generally to a system for displaying, storing and dispensing information and specifically to a yard sign including an information storage and dispensing unit which holds materials such as property pamphlets and photographs.

BACKGROUND OF THE INVENTION

In recent years, over ten million homes are either sold or rented "by owner." Current signs available to the seller who desires to sell property, such as real estate, "by owner" have certain drawbacks. Generally, such signs do not offer any means to display or store adequate information about the property. One option used in recent years includes the use of a standard "for sale" or "for rent" by owner sign in conjunction with an information tube. Such tubes require the user to curl paper to fit it in the tube, which often results in an unprofessional appearance. The tube is attached to the sign using tape or other similar adhesive, which is not suitable to withstand outdoor elements such as rain and snow. In addition, such information tubes are somewhat flimsy and include an end cap that is difficult to use and often dangles open, exposing the contents to the weather as well. As a result, any paper information included in the tube becomes unreadable and unusable. Another alternative currently employed by sellers is to write information directly on the sign, which is difficult to read and is generally incapable of conveying the required information effectively.

Accordingly, there is a need for a user to professionally display information about property for sale that is attractive, easy to use and that provides effective storage for information related to the property offered for sale.

SUMMARY OF THE INVENTION

Embodiments of the information display system of this invention provide an effective system to display, store and protect information. An H-shaped frame provides easy installation and ease of manufacture. An information storage unit is attached to the H-shaped frame and provides a sealed unit that is easy to access but that protects the contents from exposure to the elements.

DETAILED DESCRIPTION

Figure 1:
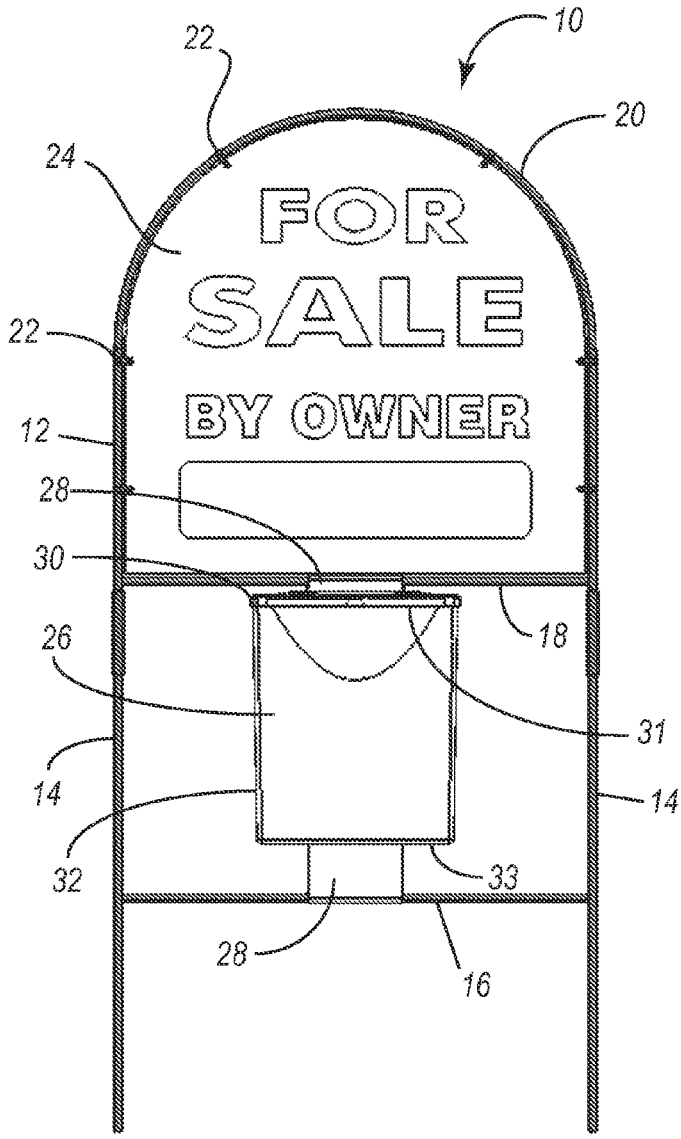
FIG. 1 is a front view of an information display system of this invention.
Figure 2:
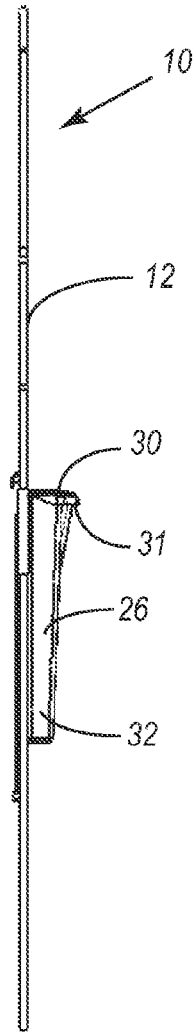
FIG. 2 is a side view of the information display system of FIG. 1.
Figure 3:
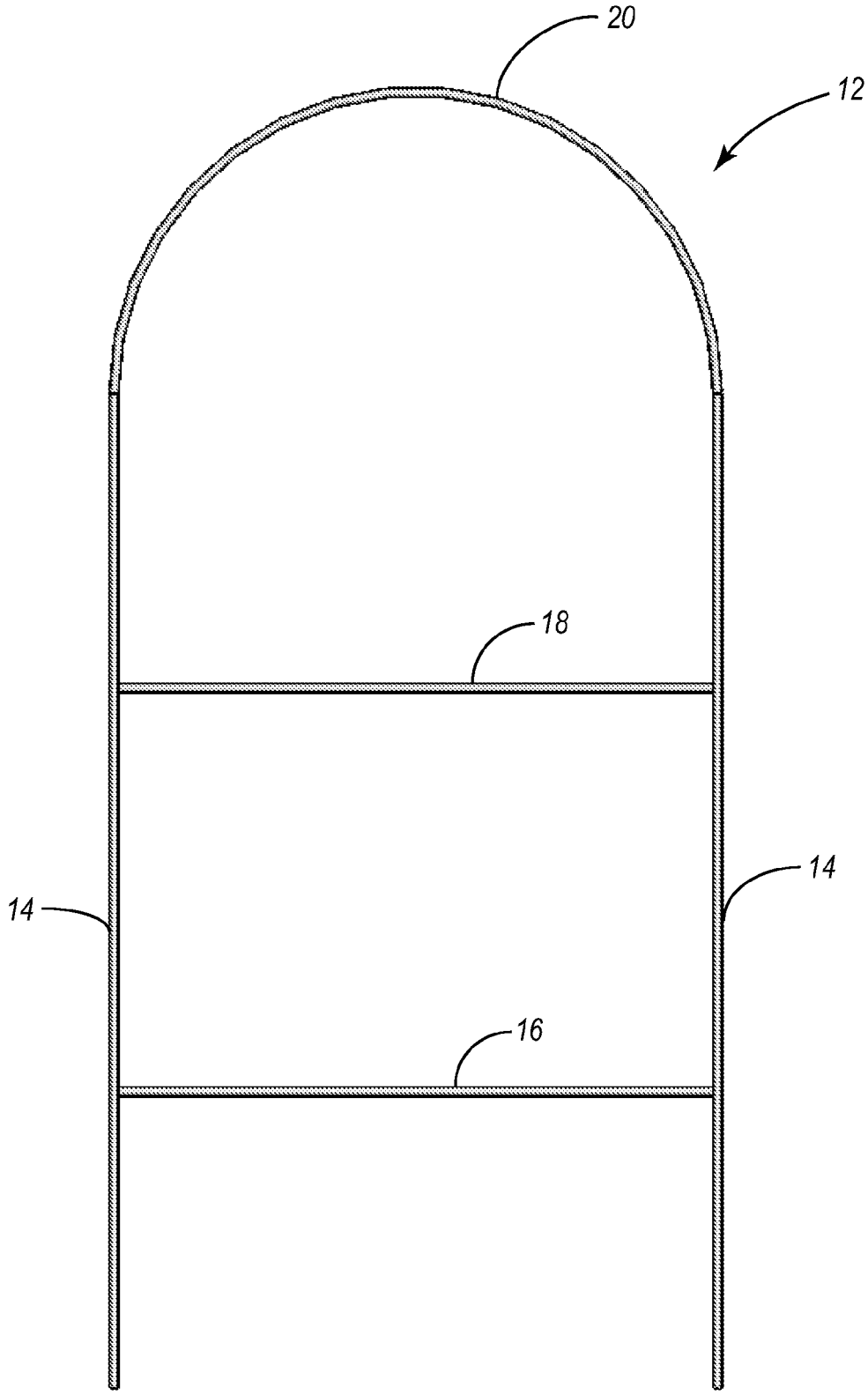
FIG. 3 is a front view of the frame of the information display system of FIG. 1.
Figure 4:
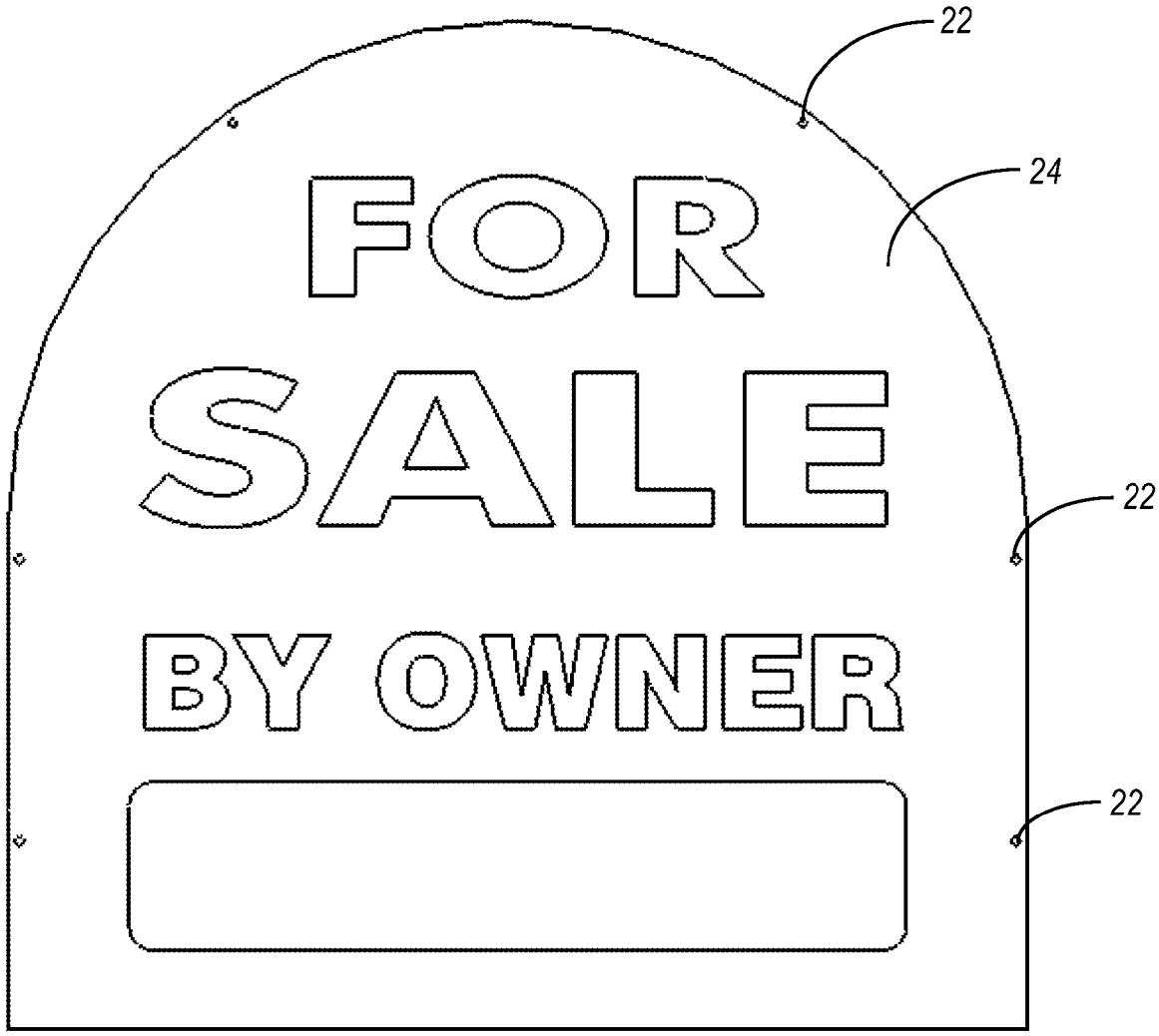
FIG. 4 is a front view of the display unit of the system of FIG. 1.
Figure 6:
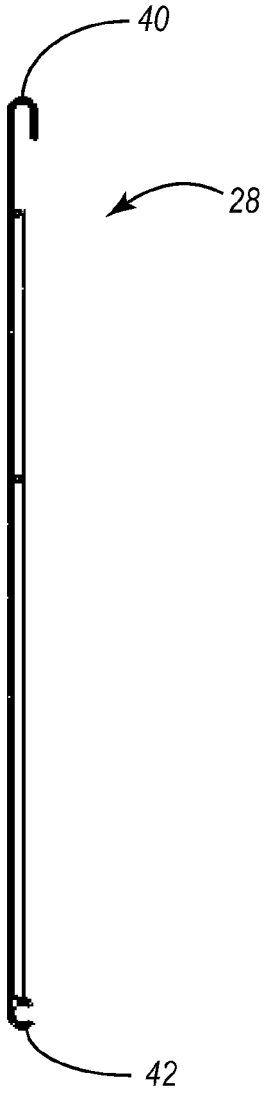
FIG. 6 is a side view of the connector of FIG. 5.
Figure 5:
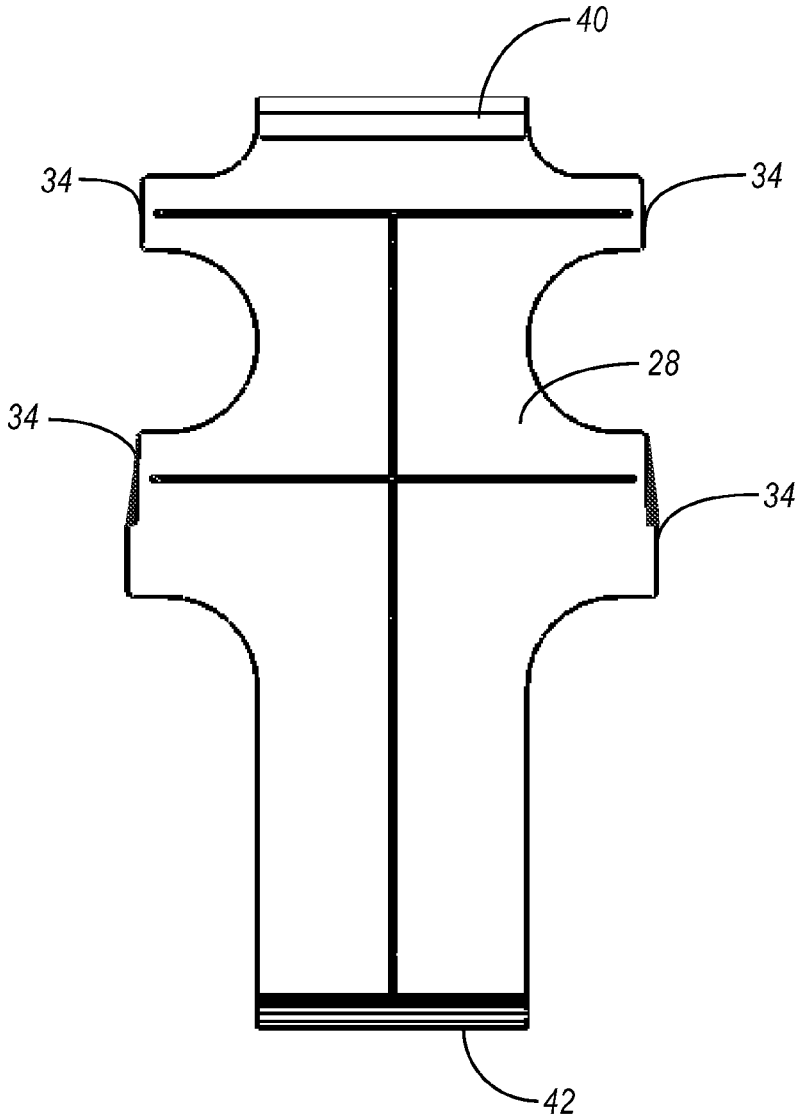
FIG. 5 is a rear view of the connector of FIG. 1.
Figure 7:
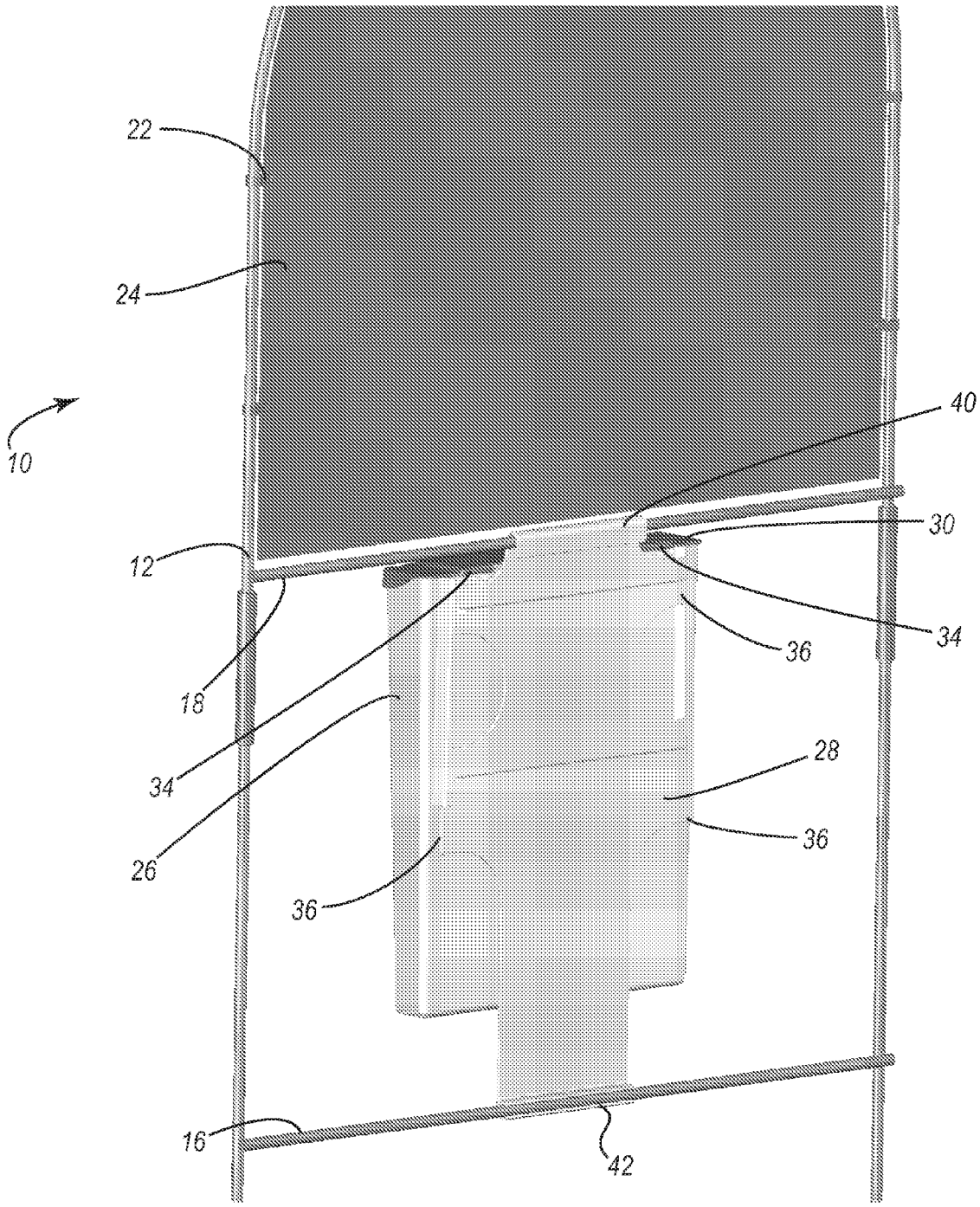
FIG. 7 is a partial rear perspective view of the information display system of FIG. 1.

An illustrative embodiment of this invention is shown in the drawings as information display system 10, which includes H-shaped frame 12 having two side bars 14 which join lower bar 16 and middle bar 18. In the embodiment shown in the drawings, upper bar 20 is curved. A plurality of fasteners 22 secure display sign 24 to the frame 12. In the embodiment shown, six fasteners are used, but any suitable number of fasteners may be used. The display sign 24 includes information such as "FOR SALE by Owner" as shown in the drawings. In other embodiments, other information may be displayed, including "For Rent" or other such indicators.

An information storage unit, shown in the drawings as box 26, is attached to frame 12 using connector 28. This unit may store information including, but not limited to, property pamphlets, photographs of the property, special offers and other suitable information. Box 26 includes a lid 30, which is attached to the body 32 of box 26 using a set of hinges 34. Hinges 34 are designed so that lid 30 tends toward a closed position. The lid 30 and the hinges 34 are configured so that the weight of the lid makes it self-closing. The lid 30 is prevented from opening fully so that when released, the lid will always drop closed. Lid 30 has a peripheral downward extending lip 31 so that when closed, lid 30 keeps rain or snow from running into the box 26. The bottom 33 of the box 26 includes apertures 35 that allow any moisture that enters the box 26 to drain.

In the embodiment shown, connector 28 includes edges 36 that slide into channels 38 on the rear side of box 26. Connector 28 includes a u-shaped clip 40 adapted to snap onto the middle bar 18 and a c-shaped clip 42 adapted to snap onto lower bar 16 of frame 12. Alternatively, both clips may be c-shaped or u-shaped, or any combination thereof, or any suiting fastener may be used.

The information display system of this invention is easy to use. The frame 12 is easily inserted into the ground by applying pressure to the lower bar 16. Information may be stored inside the information storage unit and is protected from the elements by the lid 30.

As will be appreciated by reference to the preceding description and the accompanying drawings, numerous alternative configurations of components and different materials can be used to practice this invention without departing from the spirit of the invention or the scope of the following claims. Similarly, modifications and additions in structure or configuration are possible without departing from the spirit of this invention or the scope of the following claims.

The invention claimed is:

1. A system for the display and storage of information, comprising:

(a) a frame comprising at least two side bars and at least two cross bars, (b) a box comprising:

a body including an interior space, at least one channel located on a rear surface of the box, and a lid comprising a lip, the lid connected to the body by at least one hinge, wherein the lid is prevented from opening fully; and (c) a connector comprising:

at least one edge that connects with the at least one channel on the rear surface of the box, a u-shaped clip that connects the box to a first one of the at least two cross bars, and a c-shaped clip that connects the box to a second one of the at least two cross bars.

2. The system of claim 1 wherein the frame further comprises a curved top bar.

3. The system of claim 1 wherein the interior space further comprises apertures.

4. A system for the display and storage of information, comprising:

(a) an H-shaped frame comprising two side bars, at least two cross bars and a curved top bar, (b) an information storage box comprising:

a body comprising an interior space having at least two apertures, a plurality of channels located on a rear surface of the information storage box, a lid comprising a lip, and at least one hinge for connecting the lid to the body, wherein the lid is prevented from opening fully; and (c) a connector comprising:

a plurality of edges that connect with the plurality of channels on the rear surface of the box, a u-shaped clip that connects the box to a first one of the at least two cross bars, and a c-shaped clip that connects the box to a second one of the at least two cross bars.

* * * * *